US007345491B2

(12) United States Patent
Pezier

(10) Patent No.: US 7,345,491 B2
(45) Date of Patent: Mar. 18, 2008

(54) CLOTHES DRYER MOISTURE SENSING CIRCUIT

(75) Inventor: Nicolas Pezier, Montreal (CA)

(73) Assignee: Mabe Canada Inc., Burlington (CA)

( * ) Notice: Subject to any disclaimer, the term of this patent is extended or adjusted under 35 U.S.C. 154(b) by 128 days.

(21) Appl. No.: 11/412,126

(22) Filed: Apr. 27, 2006

(65) Prior Publication Data

US 2006/0242859 A1 Nov. 2, 2006

(30) Foreign Application Priority Data

Apr. 28, 2005 (CA) ..... 2505571

(51) Int. Cl.
*G01R 27/08* (2006.01)

(52) U.S. Cl. ..... 324/694; 324/664; 73/73; 34/528

(58) Field of Classification Search ..... 324/694, 324/664; 73/73; 34/528
See application file for complete search history.

(56) References Cited

U.S. PATENT DOCUMENTS

| | | | | |
|---|---|---|---|---|
| 3,809,924 | A | 5/1974 | Grunow et al. | |
| 4,477,982 | A | 10/1984 | Cotton | |
| 4,525,937 | A * | 7/1985 | Strandberg et al. | 34/550 |
| 5,367,265 | A | 11/1994 | Gaudette | |
| 5,682,788 | A * | 11/1997 | Netzer | 73/73 |
| 6,242,927 | B1 * | 6/2001 | Adams et al. | 324/664 |
| 2001/0054903 | A1 * | 12/2001 | Adams et al. | 324/667 |

* cited by examiner

*Primary Examiner*—Vincent Q. Nguyen

(57) ABSTRACT

A moisture sensing circuit for a clothes dryer in which clothes tumble during drying has a pair of spaced apart electrode sensors for sensing the electrical resistance of the clothes when the clothes contact the electrodes. The circuit has an active filter for suppressing noise related to the operating line frequency of the clothes dryer to provide a filtered voltage signal representative of voltage drop across the electrode sensors with the line frequency noise suppressed.

6 Claims, 2 Drawing Sheets

CLOTHES DRYER MOISTURE SENSING CIRCUIT

FIELD OF THE INVENTION

The present invention relates to an appliance for drying clothing articles, and, more particularly, to a moisture sensing circuit for sensing the moisture of clothes tumbling in a clothes dryer.

BACKGROUND OF THE INVENTION

It is common practice to detect the moisture level of clothes tumbling in a dryer by the use of sensors located in the dryer drum. The sensors form part of a moisture sensing circuit that develops a voltage signal from the sensors. The voltage signal from the moisture sensing circuit is typically supplied as an input to a microprocessor controller. The microprocessor controller may periodically sample the voltage signal and use the samples to determine when the clothes are dry, near dry, or at a predetermined target level of moisture content, and the drying cycle should terminate.

As can be appreciated, the voltage signal from the sensors and moisture sensing circuit may be highly variable over time and may not accurately reflect the moisture content of the clothing articles. This signal may be effected by noise including noise related to the line current frequency used to operate the clothes dryer. Accordingly, there is a need for a moisture sensing circuit that is able to compensate for noise, and, in particular, noise related to the line operating frequency of the dryer.

BRIEF DESCRIPTION OF THE INVENTION

The present invention relates to a moisture sensing circuit for a clothes dryer in which clothes tumble during drying. The circuit comprises a pair of spaced apart electrode sensors for sensing the electrical resistance of the clothes when the clothes contact the electrodes. The circuit further comprises an active filter for suppressing noise related to the operating line frequency of the clothes dryer to provide a filtered voltage signal representative of voltage drop across the electrode sensors with the line frequency noise suppressed. The use of the active filter to suppress noise added to the signal detected by the electrode sensors related to the operating line does not suppress variation from the clothes. Since variation from clothing are typically at frequencies under 16 Hz, then the circuit provides a quick variation of signal without power line noise. This feature give more information during the period of time that the clothes touch the sensor. Hence this moisture sensing circuit improves the accuracy of the moisture related signal.

The use of the active filter suppresses noise added to the signal detected by the electrode sensors related to the operating line or supply frequency of the dryer line current and thereby improves the accuracy of the moisture related signal.

In one embodiment of the invention there is provided a moisture sensing circuit for a clothes dryer in which clothes tumble during drying. The circuit comprises a pair of spaced apart electrode sensors for sensing the electrical resistance of the clothes when the clothes contact the electrode sensors. A first low pass filter is provided in the circuit. The first low pass filter has two low pass filter inputs each connected with one of the electrode sensors and one first low pass filter output. The circuit comprises a voltage follower amplifier with high input resistance and low output resistance. The voltage follower amplifier has a first input coupled to the one low pass filter output and a first output that provides a voltage signal representative of voltage drop across the electrode sensors when clothes contact the sensors. The circuit comprises an active filter having a second input coupled with the first output of the voltage follower amplifier. The active filter further comprises a second output. The active filter suppresses noise related to operating line frequency of the clothes dryer to provide at the second output a filtered voltage signal representative of voltage drop across the electrode sensors with the operating line frequency noise suppressed.

In another embodiment, the circuit may further comprise a over voltage suppressor amplifier for protecting a microprocessor controller from high voltage spikes. The over voltage suppressor amplifier has a third input coupled to the second output of the active filter and has a third output coupled to an input of the a microprocessor controller.

In yet another embodiment, the circuit may further comprise a second low pass filter connected with the third output of the over voltage suppressor amplifier.

BRIEF DESCRIPTION OF THE DRAWINGS

For a better understanding of the nature and objects of the present invention reference may be had by way of example to the accompanying diagrammatic drawings in which.

DETAILED DESCRIPTION OF THE INVENTION

Figure 1:
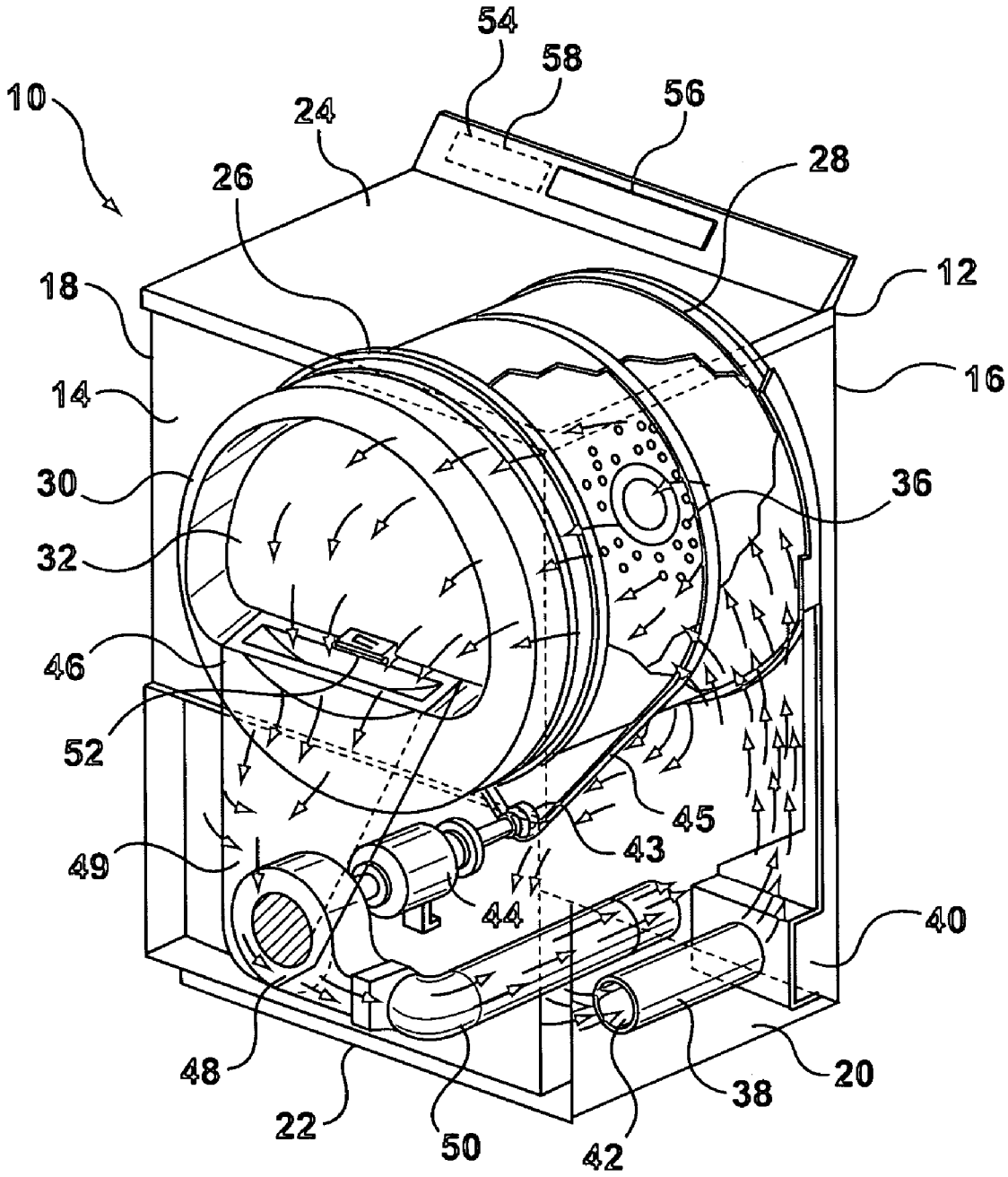
FIG. 1 is a perspective view of an exemplary clothes dryer that may benefit from the present invention; and, FIG. 2 is a circuit diagram of the moisture sensing circuit of the present invention.

FIG. 1 shows a perspective view of an exemplary clothes dryer 10 that may benefit from the present invention. The clothes dryer includes a cabinet or a main housing 12 having a front panel 14, a rear panel 16, a pair of side panels 18 and 20 spaced apart from each other by the front and rear panels, a bottom panel 22, and a top cover 24. Within the housing 12 is a drum or container 26 mounted for rotation around a substantially horizontal axis. A motor 44 rotates the drum 26 about the horizontal axis through, for example, a pulley 43 and a belt 45. The drum 26 is generally cylindrical in shape and has an imperforate outer cylindrical rear wall 28 and a front flange or wall 30 defining an opening 32 to the drum. The front wall 30 and opening 32 are normally closed by a door (not shown). Clothing articles and other fabrics are loaded into the drum 26 through the opening 32. A plurality of tumbling ribs or baffles (not shown) are provided within the drum 26 to lift the articles and then allow them to tumble back to the bottom of the drum as the drum rotates. The rear wall 28 is rotatably supported within the main housing 12 by a suitable fixed bearing. The rear wall 28 includes a plurality of holes 36 that receive hot air that has been heated by a heater such as a combustion chamber 38 and a rear duct 40. The combustion chamber 38 receives ambient air via an inlet 42. Although the exemplary clothes dryer 10 shown in FIG. 1 is a gas dryer, it could just as well be an electric dryer without the combustion chamber 38 and the rear duct 40. For an electric dryer, electrical heating elements may be located in a heater housing between the rear panel 16 and the rear wall 28. The heated air is drawn from the drum 26 by a blower fan 48 which is also driven by the motor 44. The air passes through a screen filter 46 which traps any lint particles. As the air passes through the screen filter 46, it enters a trap duct 49 and is passed out of the clothes dryer through an exhaust duct 50. After the clothing articles have been dried, they are removed from the drum 26 via the opening 32.

Moisture sensors 52 are used to predict the percentage of moisture content or degree of dryness of the clothing articles in the container. Moisture sensors 52 typically comprise a pair of spaced-apart rods or electrodes and further comprise circuitry 54 for providing a voltage signal representative of the moisture content of the articles to a controller 58 based on the electrical or ohmic resistance of the articles. When the clothing articles touch the electrode sensors 52, the voltage across the electrode sensors 52 drops towards a minimum value representative of the moisture content of the clothes. The moisture sensors 52 may be located on the front interior wall of the drum. Alternatively, moisture sensors 52 may be located on a rear drum 28 wall for stationary rear drum walls. In some instances the moisture sensors have been used on baffles contained in the dryer drum. The moisture sensing circuit may be located with the sensors 52, on the control panel as shown in FIG. 1, or in any other suitable location with the clothes dryer 10. By way of example and not of limitation, the voltage signal representative of the moisture content may be chosen to provide a continuous representation of the moisture content of the articles and be in a range suitable for processing by microprocessor controller 58. Typically, this is a range of 1 to 5 volts.

The controller 58 is responsive to the voltage signal from moisture sensing circuit 54 and predicts a percentage of moisture content or degree of dryness of the clothing articles in the drum as a function of the resistance of the articles.

An electronic interface and display panel 56 allows the user to program operation of the dryer and further allows for monitoring progress of respective cycles of operation of the dryer.

Figure 2:
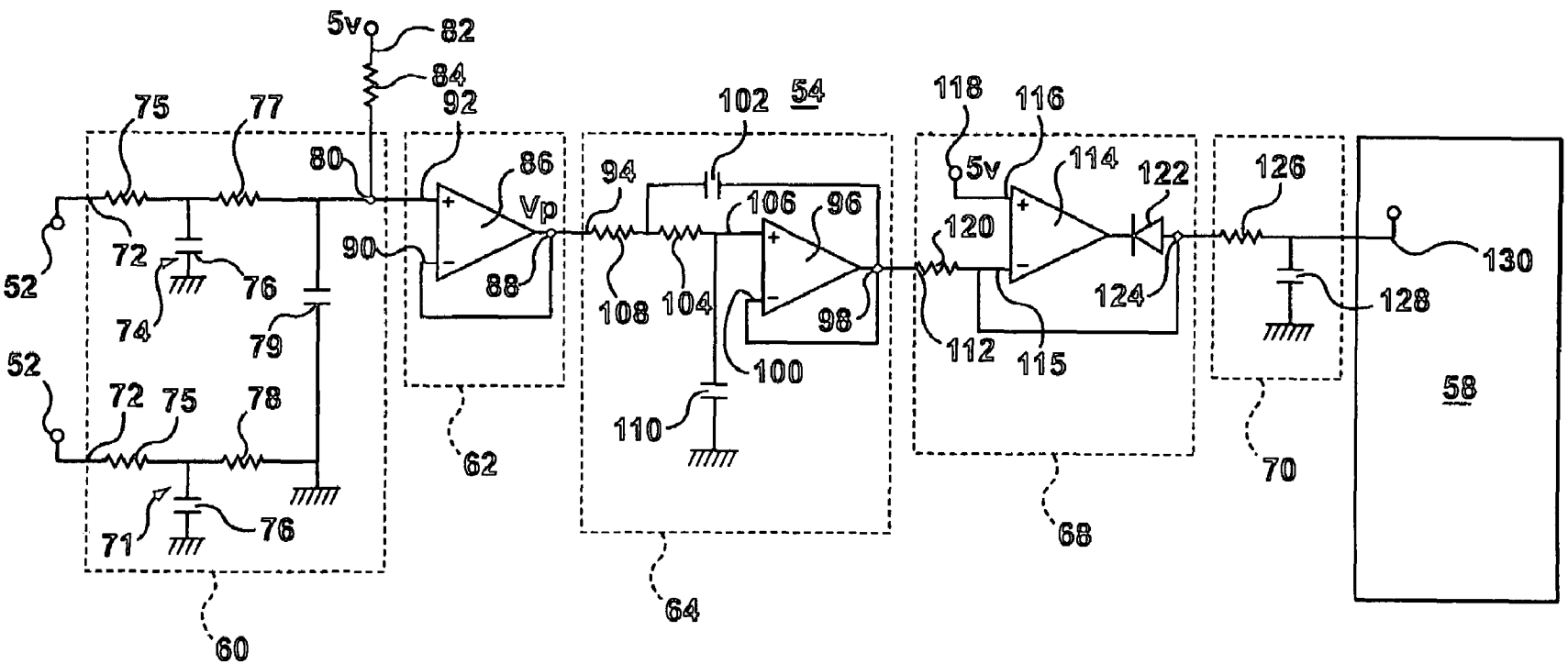

Referring to FIG. 2, the moisture sensing circuit 54 of the present invention is shown in detail. The moisture sensing circuit 54 is connected to the pair of spaced apart electrode sensors 52 which can thereby be said to form part of the moisture sensing circuit 54. Sensors 52 sense the electrical resistance of clothes when the clothes contact both the electrode sensors 52. The electrode sensors 52 are connected electrically with a first low pass filter 60. The low pass filter 60 has two inputs 72 each respectively connected with one of the electrode sensors 52. Each input 72 is followed in the circuit by low pass filters 71 and 74 each comprising resistor 75 and capacitor 76. The low pass filter 74 is interconnected via resistor 77 to output 80 of low pass filter 60. The low pass filter 71 is connected to ground via resistor 78 to provide a reference for the moisture signal. Output 80 is connected to ground via capacitor 79 to protect the non-inverting input of operational amplifier 88 from over voltage conditions. The output 80 of low pass filter 60 is further held at a voltage potential of 5 volts by supply 82 through resistor 84. When clothes contact the electrode sensors 52, a voltage drop occurs across these sensors causing the voltage value at output 80 to drop in accordance with the electrical resistance of the clothing across sensor electrode sensors 52.

The moisture sensing circuit 54 further comprises a voltage follower amplifier 62. This amplifier 62 comprises an operational amplifier 86 having its output 88 fed back to its inverting input 90. The non-inverting input 92 of the voltage follower amplifier 62 is connected to the output 80 of the first low pass filter 60. The voltage follower amplifier 62 provides a high input resistance and a low output resistance to the signal and provides a voltage signal Vp at the output 88 which is representative of the moisture level of the clothes when the clothes are in contact with the electrodes 52. Otherwise, when no clothes are in contact with electrodes 52, the output voltage Vp is in the order of 5 volts.

The output 88 of the voltage follower amplifier 62 is connected to an input 94 of an active filter 64. The active filter 64 is a second-order, Salen-and-Key active low-pass filter comprising an operational amplifier 96 having its output 98 connected directly to its inverting input 100 and indirectly through capacitor 102 and resistor 104 to its non-inverting input 106. The active filter 64 further includes an input resistor 108 and another capacitor 110. The values of the resistors and capacitors are chosen to suppress frequencies at the clothes dryer line operating frequencies. That is typically at 60 hertz. In other jurisdictions or areas this line operating frequency may be 50 hertz. By suppressing the line operating frequency of the clothes dryer from the signal $V_p$, any noise associated with the line operating frequency is suppressed providing a signal having less noise and not being effected by the operating line frequency of the clothes dryer.

The output 98 of the active filter 64 is connected with an input 112 of an over voltage suppressor amplifier 68. The purpose of the over voltage suppressor amplifier 68 is to protect the microprocessor controller 58 from spikes in the voltage which might otherwise damage the microprocessor controller 58. The over voltage suppressor amplifier 68 comprises an operational amplifier 114 having an non-inverting input 116 connected to a 5 volt power supply 118. The inverting input is directly connected via a resistor 120 to the input 112 of the over voltage suppressor amplifier 68. The output of the amplifier 114 passes through an inverted diode 122 to an output 124 for the over voltage suppressor amplifier 68. This output 124 is fed directly back to the inverting input 115 of the amplifier 114.

The output 124 of the over voltage suppressor amplifier is connected to an optional low pass filter 70. This filter adds a layer of protection for signals being submitted to the microprocessor controller 56. Low pass filter 70 further comprises a resistor 126 and a capacitor 128. The output of the second low pass filter 70 is connected to an input 130 of the microprocessor controller 56.

The circuit 54 of the present invention provides for raw voltage signals associated with voltage drops across the electrode sensors 52 to be transferred through directly to the microprocessor controller 56 with noise associated with voltage spikes being suppressed from the signal and noise associated with the operating line frequency of the clothes dryer being suppressed.

While the invention has been described in terms of various specific embodiments, those skilled in the art will recognize that the invention can be practiced with modifications within the spirit and scope of the present invention as disclosed herein.

What is claimed is:

1. A moisture sensing circuit for a clothes dryer in which clothes tumble during drying, the circuit comprising:

a pair of spaced apart electrode sensors for sensing the electrical resistance of the clothes when the clothes contact the electrode sensors;

a first low pass filter having two low pass filter inputs each connected with one of the electrode sensors and one first low pass filter output;

a voltage follower amplifier with high input resistance and low output resistance, the voltage follower amplifier having a first input coupled to the one low pass filter output, and the voltage follower amplifier having a first output that provides a voltage signal representative of voltage drop across the electrode sensors when clothes contact the sensors; and, an active filter having a second input coupled with the first output of the voltage follower amplifier, the active filter further comprising a second output and the active filter suppressing noise related to operating line frequency of the clothes dryer to provide at the second output a filtered voltage signal representative of voltage drop across the electrode sensors with the operating line frequency noise suppressed.

2. The moisture sensing circuit of claim 1 further comprising a over voltage suppressor amplifier for protecting a microprocessor controller from high voltage spikes, the over voltage suppressor amplifier having a third input coupled to the second output of the active filter and having a third output coupled with an input of the a microprocessor controller.

3. The moisture sensing circuit of claim 2 further comprising a second low pass filter connected with the third output of the over voltage suppressor amplifier.

4. The moisture sensing circuit of claim 1 wherein the operating line frequency noise is one of 50 Hz and 60 Hz.

5. The moisture sensing circuit of claim 1 wherein the active filter is Salen-and-Key active low-pass filter.

6. The moisture sensing circuit of claim 5 wherein the active filter comprises an operational amplifier providing the second output, the second output is directly coupled back to an inverting input of the operational amplifier and indirectly coupled through a capacitor and resistor to a non-inverting input of the operational amplifier, and the non-inverting input being coupled with the first output of the voltage follower amplifier.

* * * * *